US005311989A

United States Patent [19]

Ward et al.

[11] Patent Number: 5,311,989

[45] Date of Patent: May 17, 1994

[54] COMMON BLISTER BATTERY PACKAGE AND DISPLAY

[75] Inventors: Thomas F. Ward, Madison; Joseph R. Kuehn, Black Earth; Stephen B. Studee, Middleton, all of Wis.

[73] Assignee: Rayovac Corporation, Madison, Wis.

[21] Appl. No.: 82,745

[22] Filed: Jun. 25, 1993

[51] Int. Cl.[5] ..... B65D 85/20; B65D 73/00

[52] U.S. Cl. ..... 206/333; 206/471

[58] Field of Search ..... 206/328, 332, 333, 461–471

[56] References Cited

U.S. PATENT DOCUMENTS

| | | | |
|---|---|---|---|
| 3,408,234 | 10/1968 | Ririe, Jr. . | |
| 3,881,601 | 5/1975 | Walus et al. | 206/471 |
| 4,534,465 | 8/1985 | Rothermel et al. | 206/443 |
| 4,723,656 | 2/1988 | Kiernan et al. | 206/333 |
| 4,816,735 | 3/1989 | Cook et al. | 320/2 |
| 4,896,770 | 1/1990 | Calcerano et al. | 206/333 |
| 4,958,731 | 9/1990 | Calcerano | 206/333 |
| 5,029,705 | 7/1991 | Schmidt et al. | 206/333 |
| 5,143,215 | 9/1992 | Hartley et al. | 206/333 |

*Primary Examiner*—Jimmy G. Foster
*Attorney, Agent, or Firm*—Lathrop & Clark

[57] ABSTRACT

The plastic blister of the package has a lip which is bonded to a stiff backing card to define a space for retaining one or more batteries. Portions of the blister overlie the positive and negative terminals of the batteries to prevent the rotation of the battery within the package. The portions overlying the negative terminal have protrusions which extend inward toward the negative terminal battery. The protrusions are formed so as to engage more tightly battery features of larger size, or to come into greater contact with certain batteries. These "progressive retention" features ensure rotation-preventive engagement with the positive contact nubbins. Thus, batteries of slightly differing size or end configuration will be retained by one or more retention features, as the size and configuration of the battery packaged within the blister is varied. Similarly, the portions of the blister engaging the positive end resiliently engage the negative terminal of the battery. Additionally, one other retention feature is formed as a portion of the blister which protrudes inwardly to grip a feature of the positive terminal. A common blister may thus be employed with batteries of the same standard output yet with dimensions which vary within the allowable standard.

10 Claims, 6 Drawing Sheets

COMMON BLISTER BATTERY PACKAGE AND DISPLAY

FIELD OF THE INVENTION

This invention relates to blister packages in general, and to blister packages for displaying batteries in particular.

BACKGROUND OF THE INVENTION

Consumer batteries are commonly sold in blister card packages hung from display rods located near the point of purchase. An important function of the clear plastic blister which is affixed to the blister card and contains the batteries is to allow individual visual display of the batteries contained therein. The most appealing and informative information concerning the battery is normally printed on the battery itself. This display material on the battery identifies the brand and the type of the battery. In order that the information printed on the battery may be readily seen by the consumer, the rotation of the batteries within the package must be prevented between the time of manufacturing when the batteries are oriented within the blister for viewing by the consumer and the sale of the batteries. Thus the orientation set at the factory must be preserved by the plastic blister. This anti-rotation feature of the plastic blister is normally achieved by protrusions which engage the top and bottom of the battery. These protrusions normally engage a single feature on each end of the battery, and are thus battery specific.

Batteries of a standard cell size, such as a "D" size battery, may have a range of dimensions both in length, diameter, and the positive terminal nubbin diameter. A standard "D" cell may employ one of several different chemistries. These chemistries provide batteries of different total energy content with different costs that generally correspond to the energy content of the battery. Different chemistries involved in modern batteries result in radically different structures internal to a battery, yet externally the batteries appear, and for most purposes are, interchangeable. The differences of internal battery structure and energy content are what cause the minor differences in battery geometry. These geometric differences are normally accommodated in battery-using devices by spring-loaded contacts which accommodate themselves to the range of battery configurations allowed within the industry standard for a consumer battery.

In order to prevent rotation of a particular battery, the blister must engage the battery. Design optimization has resulted in blisters with protrusions which grip a unique feature or dimension of a particular type of standard cell. Thus, the typical blister designed to work with a common zinc "D" cell will not properly accommodate or prevent the rotation of a heavy duty alkaline "D" battery.

Heretofore, the requirement of a unique blister for each type of "D" or "C" cell has been generally accepted as a given of consumer batter production. Batteries are commodities of mass consumption and the economies of scale with each battery type is such that little attention was directed to the requirement of a different blister package for each battery type.

However, in recent years, new management and manufacturing philosophies originating in the United States, but first widely put into practice in Japan, have focused attention on new ways to improve quality and decrease cost in the manufacturing process. These new manufacturing techniques involve controlling inventory at all stages of the manufacturing process through close coordination with suppliers. The new manufacturing techniques also involve the rapid change over of tooling so that many products may be manufactured on a single line. The result of these techniques has been lower costs through reduced inventory and improved quality through more timely feedback of quality problems through the manufacturing chain.

What is needed is a blister package for the display of batteries which can contribute to lower blister inventory and reduce change-over times on battery manufacture and packaging lines.

SUMMARY OF THE INVENTION

The blister card battery package of this invention has a plastic blister attached to a backing member. The backing member is normally constructed of cardboard and has material printed thereon to indicate the type, size and manufacturer of the batteries contained in the blister pack. The blister is thermoformed from sheet stock of clear plastic, normally ABS, polyvinylchloride, polypropylene or polyester. After the blister is formed, it is cut from the sheet or roll stock. The individual blisters are nested together and shipped to the battery manufacturer who places batteries within the blister which is then bonded to the blister card, sealing the batteries between the blister and the card.

The plastic blister has a peripheral lip which is bonded to the backing member. The blister and the backing member define a space for retaining one or more batteries. The blister pack employs portions of the blister which overlie the positive and negative terminals of the batteries to prevent the rotation of the battery within the blister pack. The portions overlying the negative terminal have protrusions which extend inward toward the negative terminal battery. The protrusions are formed so as to engage more tightly battery features of larger size, or to come into greater contact with certain batteries. These "progressive retention" features ensure rotation-preventive engagement with the positive contact nubbins. Thus, batteries of slightly differing size or end configuration will be retained by one or more retention features, as the size and configuration of the battery packaged within the blister is varied. Similarly, the portions of the blister engaging the positive end resiliently engage the negative terminal of the battery. Additionally, one other retention feature is formed as a portion of the blister which protrudes inwardly to grip a feature of the positive terminal.

It is an object of the present invention to provide a blister package for displaying batteries which is adapted to prevent the rotation of batteries of varying dimensions within a standard size.

It is another object of the present invention to provide a blister package for displaying batteries which facilitates reduced inventory for battery packaging lines.

It is a further objects of the present invention to provide a blister package for displaying batteries which facilitates the reconfiguration of battery production and packaging lines.

Further objects, features, and advantages of the invention will be apparent from the following detailed description when taken in conjunction with the accompanying drawings.

DESCRIPTION OF THE PREFERRED EMBODIMENT

Referring more particularly to FIGS. 1-15 wherein like numbers refer to similar parts, a consumer display battery blister package 20 of the present invention is shown in FIGS. 6-12. This package has a thermoformed blister 54 which is sealed to a stiff card 62 for informational display of the batteries 68 contained therein. The package 20 has progressive retention features which retain the packaged batteries at there original rotational orientation such that the label and other indicia (not shown) displayed on the battery jacket are presented for customer inspection through the transparent blister 54. This package configuration allows for minimal package size, with most relevant product information being carried on the product itself.

It is important to note that the with time and research, the design of consumer batteries has changed to respond to a particular product or consumer demand. In addition, new needs have required many more varieties of batteries. Even with the introduction of new types of batteries, earlier types may continue to remain in production. Thus a single battery manufacturer may have numerous battery designs in production at once. Different battery chemistries may employ different terminals, different wall and insulative materials, and different internal chemical compartment geometries. Although batteries of a certain "size." i.e.: "D," meet industry standards for location of contacts and overall dimensions, the various crimps, sidewall-to-top wall joints, and corners may vary from battery to battery.

Figure 15:
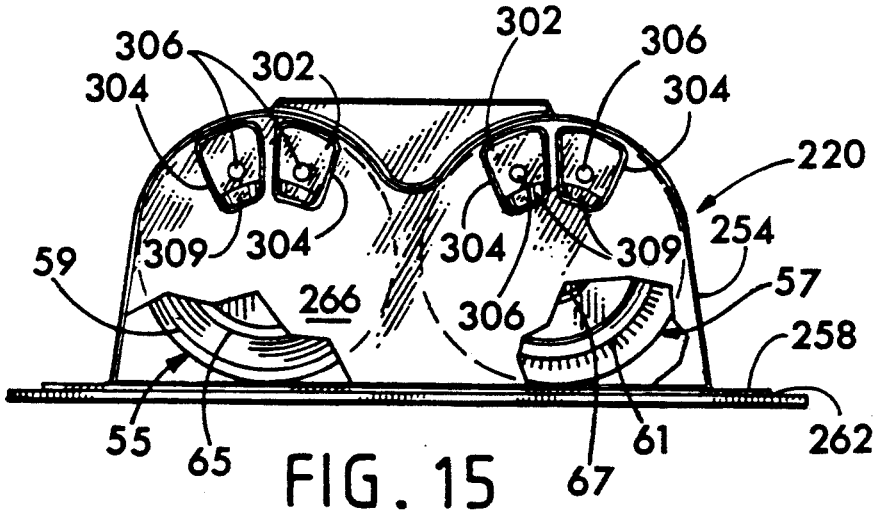
FIG. 15 is a bottom plan view of the battery blister package of FIG. 14.

Two exemplary batteries are shown in FIG. 15. A first battery 55 has a narrow and deep sidewall lip or crimp 59. A second battery 57 has a crimp or lip 61 which is wider and relatively narrow in depth. Furthermore each battery 55, 57 has an inner negative terminal protruding annulus 65, 67 which differs in diameter and height. These two batteries serve merely as an example of how cells of a common "size" can vary in structure in a number of significant ways.

Figure 1:
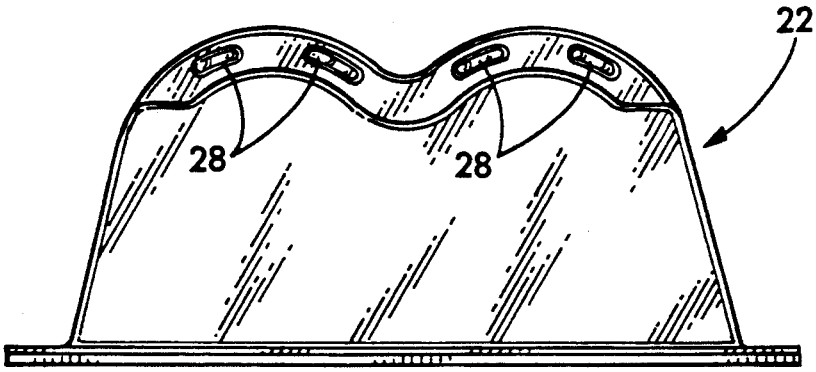
FIG. 1 (PRIOR ART)
FIG. 1 is a front elevational view of a Prior Art battery blister package.

Prior Art battery blister packs 22, 24, 26 are shown in FIG. 1, FIGS. 2 and 3, and FIGS. 4 and 5 respectively. The Prior Art battery blister packages 22, 24, 26 were each designed to package batteries of a specific dimensions. For example, the battery blister pack 22 of FIG. 1 employs small inwardly extending protrusions 28 which engage with the top and bottom of the battery of given dimensions to engage it snugly and assist in preventing it from rotating. The battery blister package 22 of FIG. 1 is designed to function with a battery of very narrowly defined geometric dimensions. The protrusions 28 are circular segments located at a fixed distance from the exterior face of the package and are suited to engage with an annular depression on the negative terminal of the packaged battery. The location of any such depression is not regulated by the industry standard. Hence, while one battery of a certain size may include an annular depression at the required location, another battery's depression may be located radially inwardly to such an extent that it is entirely nonadjacent to the protrusions 28. If a battery of the same general size but with slightly different sized positive or negative terminal features is manufactured, another specifically designed battery blister package must be designed and produced to accommodate it.

Figure 2:
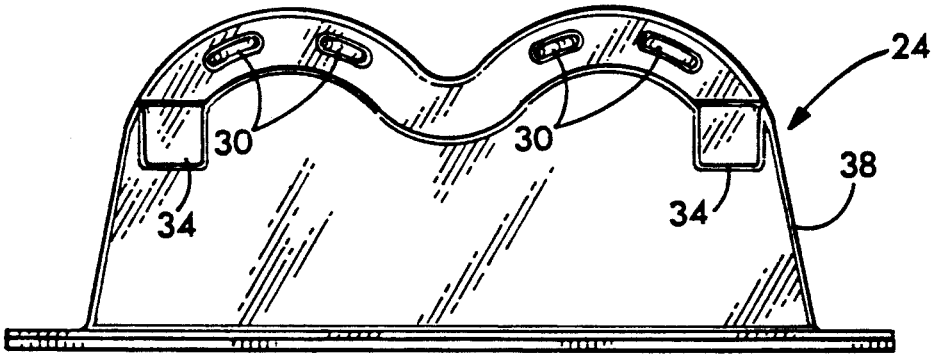
FIG. 2 (PRIOR ART)
FIG. 2 is a front elevational view of another Prior Art battery blister package.
Figure 3:
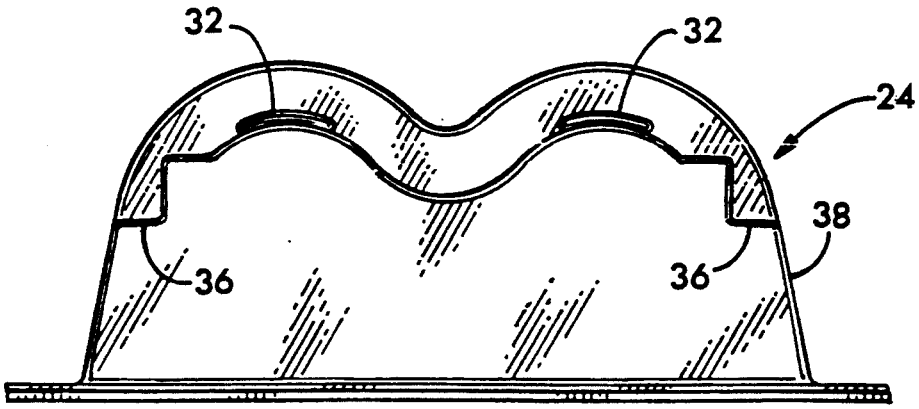
FIG. 3 (PRIOR ART)
FIG. 3 is a rear elevational view of the Prior Art battery blister package of FIG. 2.

Another prior art battery blister pack 24, shown in FIGS. 2 and 3, employs inwardly extending protrusions 30, shown in FIG. 2, which grip the positive terminal end of a battery as well as longer, thinner, protrusions 32, shown in FIG. 3, which grip an annular depression in the negative end of a battery. The battery blister pack 24 of FIGS. 2 and 3 also employs denesting protrusions 34 shown in FIGS. 2 and 36 shown in FIG. 3. The denesting protrusions 34, 36 extend inwardly toward the contained batteries but do not engage with the batteries contained in the blister pack 24. The denesting protrusions 34 and 36 prevent the individual blisters 38 from nesting too closely when they are stacked together for packaging and storage prior to being bonded to the blister cards 40.

Figure 4:
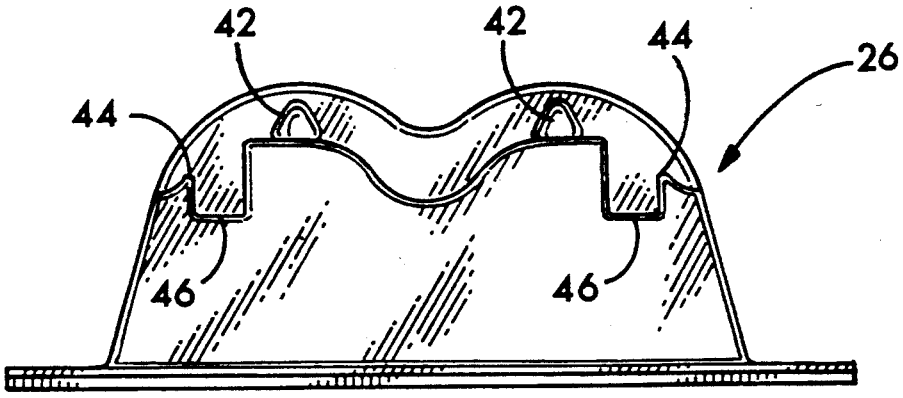
FIG. 4 (PRIOR ART)
FIG. 4 is a front elevational view of yet another Prior Art battery blister package.
Figure 5:
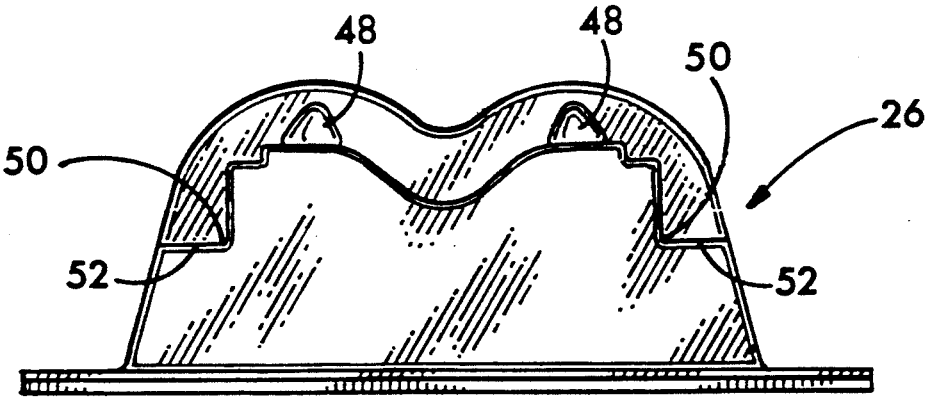
FIG. 5 (PRIOR ART)
FIG. 5 is a rear elevational view of the Prior Art battery blister package of FIG. 4.

Yet another prior art blister package 26, shown in FIGS. 4 and 5, is similarly designed to the blister packages 22, 24 of FIGS. 1 and 2 and 3 inasmuch as it is designed to fit batteries of a single given geometry and dimensions. The positive terminal end of a battery is gripped by protrusions 42 shown in FIG. 4 and also by portions 44 of the denesting protrusions 46 which extend inward toward battery positive terminal. Similarly, the negative end of a battery is gripped by protrusions 48 and also by portions 50 of the denesting protrusions 52 shown in FIG. 5 which extend inward toward a battery negative terminal.

None of the Prior Art battery blister packages 22, 24, 26 have specific structure designed for retaining batteries of varying dimensions within a single standard blister package.

Figure 6:
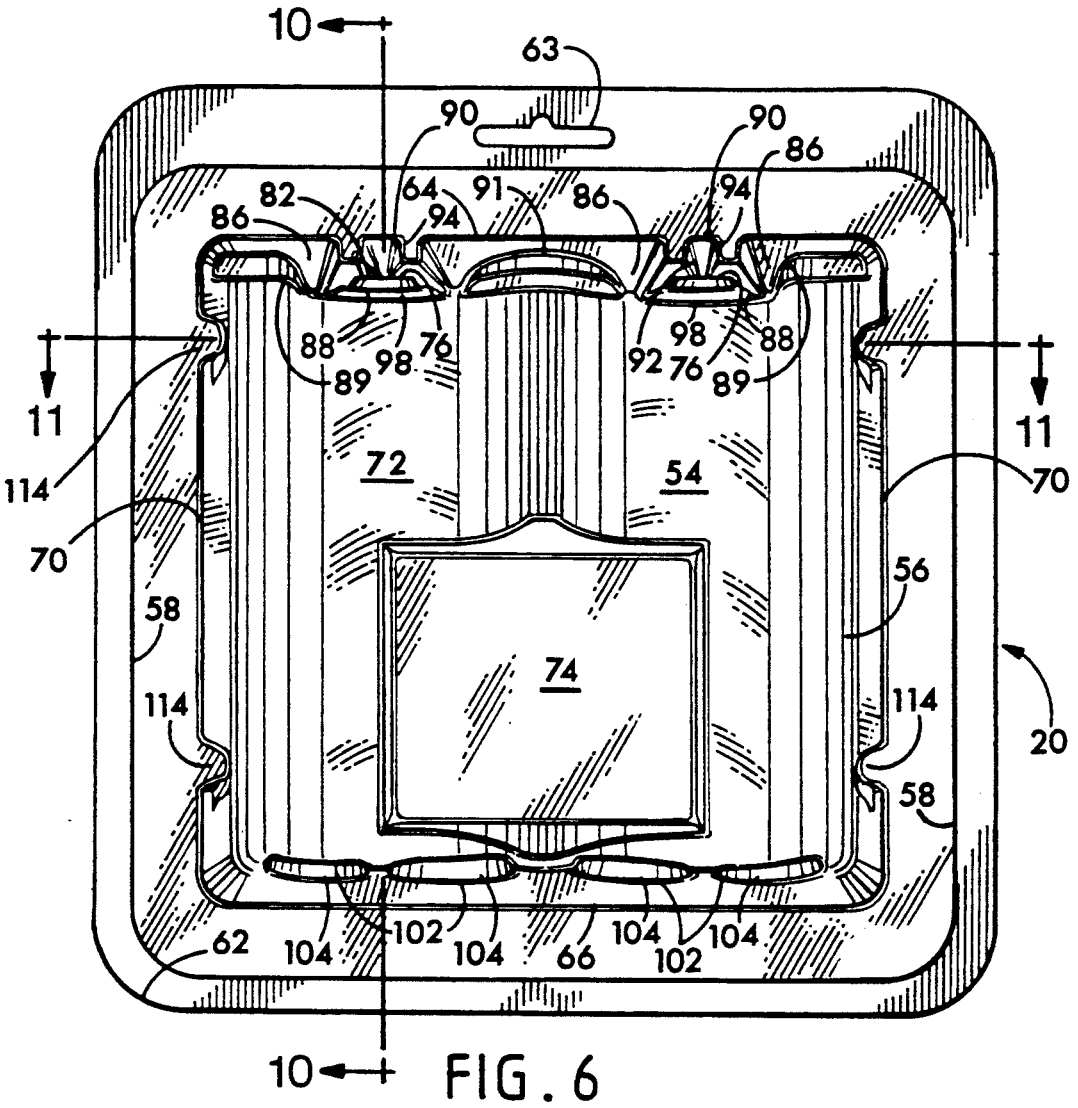
FIG. 6 is a front elevational view of the battery blister package of the present invention.

The battery blister card package 20 of the present invention, best shown in FIG. 6, is designed to hold two batteries of a common type, for example two "D" cells, in a side-by-side arrangement. The battery blister card pack 20 has structure which allows it to accommodate multiple types or varieties of "D" cells of non-uniform dimensions. In other words, a single packaging line utilizing identical blister packages 20 may package a variety of different batteries of the same standard size classification (i.e.: D, C, AA, AAA).

The blister 54 is typically constructed by thermoforming from polypropylene sheet stock. The blister are normally supplied to the battery manufacturer as a purchase item. The blister 54 defines a pocket 56 into which batteries are placed whereupon the blister is bonded by a peripheral lip 58 by an adhesive 60 to a blister card 62. The blister pocket 56 which forms a space for the battery or batteries is defined between the top of the blister 64, which overlies the top or positive terminal; the bottom 66 of the blister 54, which underlies the bottom or negative terminal of the packaged batteries 68; and the sides 70 and the front 72 of the blister 64. The front 72 of the blister 54 has a flat display portion 74 for the retention and display of promotional materials and the like.

Both the top 64 and bottom 66 of the blister 54 have structure thermoformed therein for engaging with packaged batteries. This structure is progressively retentive in that it will engage with a battery of certain minimal dimensions, yet will also expand to accommodate in a resilient manner batteries of larger dimensions.

Figure 7:
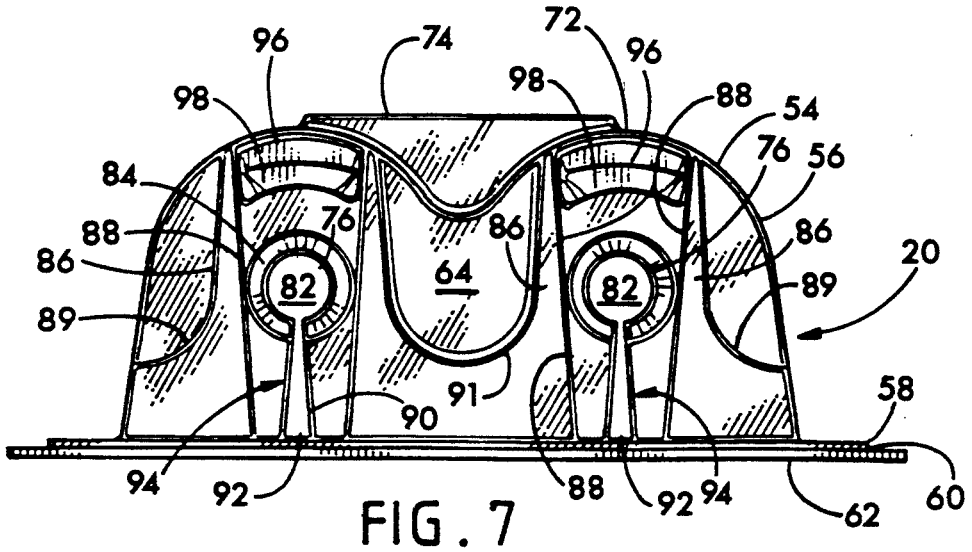
FIG. 7 is a top plan view of the blister package of FIG. 6.

The blister top 64, best shown in FIGS. 6 and 7, overlies the positive terminal of the battery 68 and is symmetrical about a plane which divides the pocket between the two packaged batteries. The top 64 has two resilient retentive features which engage each battery: a curved wedge 98 and a frustoconical nubbin cap 76. The nubbin caps provide a means for resiliently engaging the nubbin of a battery positive terminal end. The nubbin caps have circular flats 82 with downwardly extending frustoconical sidewalls 84 which meet a depression floor 88 which is at approximately the same level as two lower segments 89 on the top. The nubbin cap 76, which might otherwise lack resilience sufficient to engage the nubbin, is connected by a resilient nubbin cap arm 90 which extends above the depression floor 88 and which extends from the blister lip 58 to the cap circular flat 82. The cap arm 90 has a top wall 92 which slopes downwardly toward the cap flat 82 and which narrows as it extends towards the cap flat. The cap arm 90 has sidewalls 94 which extend between the cap arm top wall 92 and the depression floor 88.

Whereas the prior art blister packages shown in FIGS. 1-5 engage the positive terminal end lip, the package of the present invention engages the battery nubbin and hence centers the battery within the package, more readily positioning other portions of the battery for engagement by the package.

Figure 10:
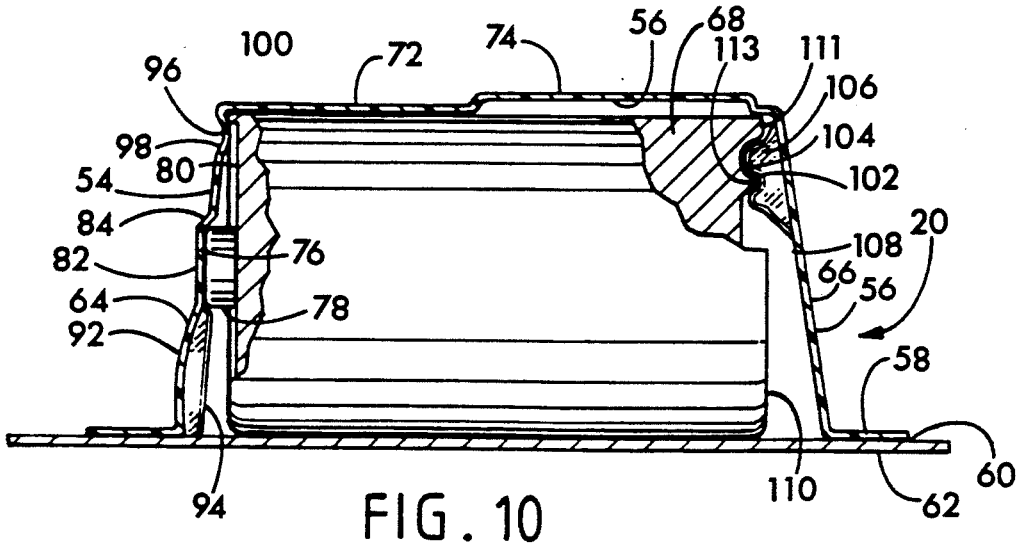
FIG. 10 is a cross sectional view of the battery blister package of FIG. 6 taken along section line 10—10.
Figure 11:
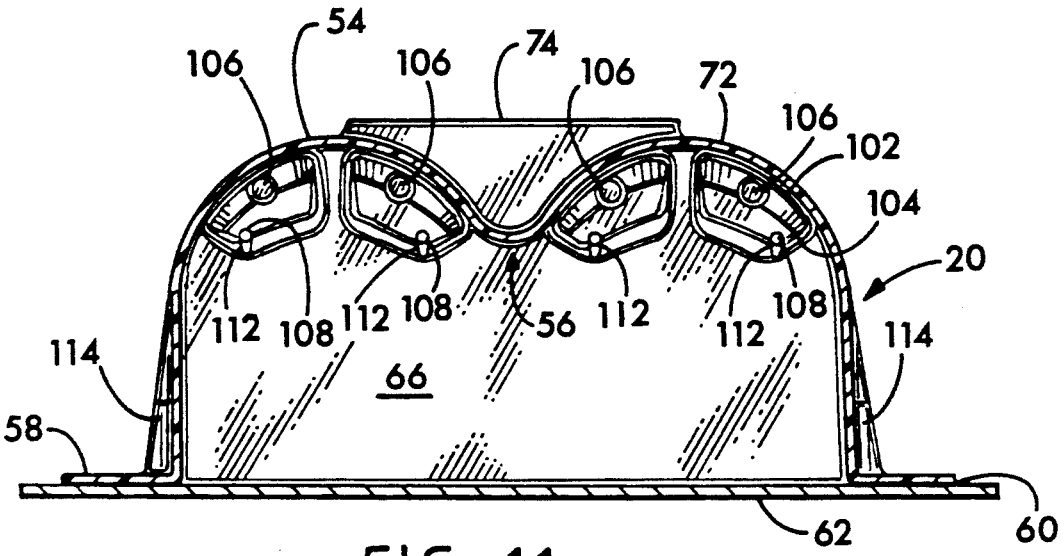
FIG. 11 is a cross sectional view of the battery blister package of FIG. 6 taken along section line 11—11.

Providing additional retention of a battery in coaction with the nubbin caps are two battery-lip-engaging downwardly protruding wedges 98, best shown in FIGS. 7 and 10. Each wedge provides a means for resiliently engaging the annular depression in the battery positive terminal end formed by the battery lip 100. One curved wedge extends below each depression floor 88 frontward of the nubbin cap. Each wedge 98 has a progressive ramped wedge surface 96 which serves to progressively engage the lip 100 of a battery 68, thereby accommodating batteries of varying lip dimensions 100 and battery radii.

Although the wedges 98 and nubbin caps 76 on the nubbin cap arms 90 provide resilient engagement with the positive terminal portions of the batteries, it is important that the top 64 of the blister be sufficiently stiff to hold the wedges and caps in engagement with the batteries. This stiffness is provided by several upwardly protruding and rigidifying legs which extend from the top 64 and extend between the lip 58 and the front 72 of the blister 54. These legs and the cap arm 90 present the appearance of two structural W's to reinforce the top 64.

The cap arm 90 inwardly biases the cap flats 82 and serves to resist outward movement of the circular flats 82 in cooperation with the legs 86 of the W structures 88. The outer surface 92 in conjunction with the side surfaces 94 best shown in FIGS. 6 and 9 serve to stiffen the V structures 90 and, thus, the nubbin caps 76. The frustoconical sidewalls 84 of the nubbin caps 76 serve to wedge against and engage nubbins 78 of the batteries 68 which may not be precisely aligned with the circular flats 82 or which may be of greater or lesser diameter. The legs 86 which extend upwardly from the top lower segments 89 and adjacent the depression floors 88, together with an upwardly protruding U-shaped structure 91 help to increase the structural stiffness of the top 64 of the blister 54.

The blister card 62 preferably has a hanging hole 63 to facilitate the display of the packaged batteries. The battery blister pack 20 incorporates structure in the top portion 64 which engages the positive terminal of a battery 68. Thus, the nubbin caps 76 and lip-engaging wedges, together with the stiffening arms and legs, provide a resilient engaging structure capable of adapting to batteries of varying dimensions and nubbin diameters.

Figure 8:
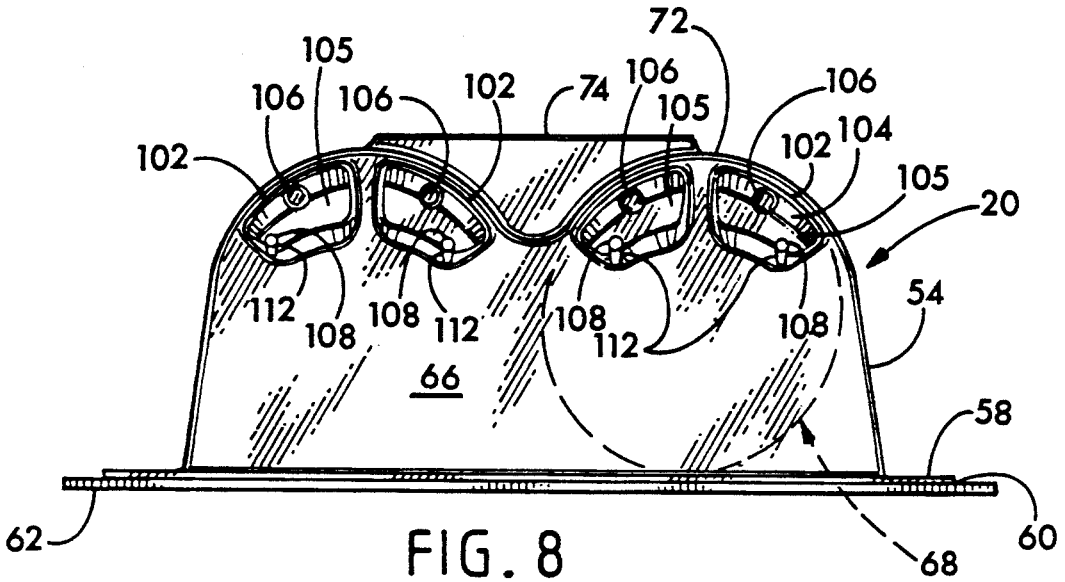
FIG. 8 is a bottom plan view of the blister package of FIG. 6.
Figure 9:
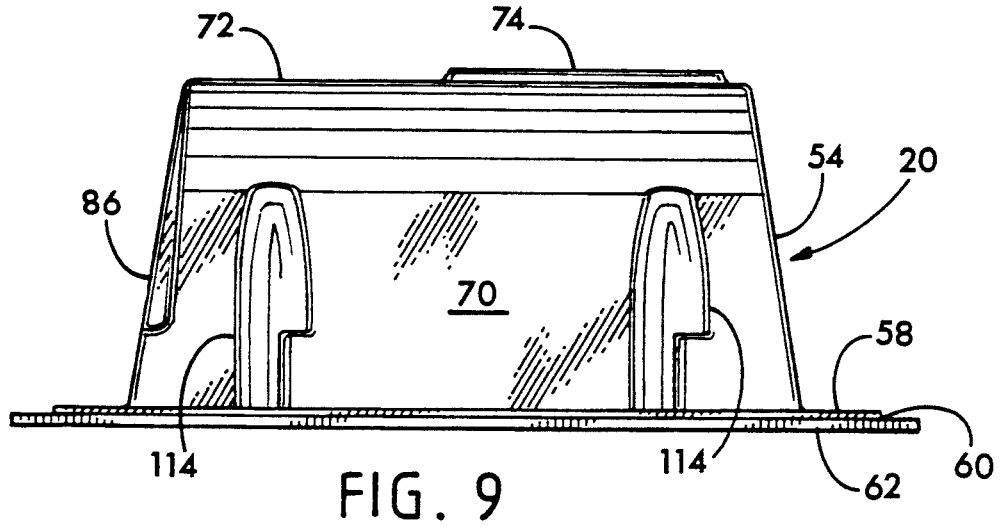
FIG. 9 is a side elevational view of the blister package of FIG. 6.

The bottom 66 of the blister 54, best shown in FIG. 8, has bottom sector-shaped, inwardly extending depressions 102 which are located adjacent to the front 72 of the blister 54. The depressions 102 provide means for resiliently engaging the negative terminal end of the battery. Two sector-shaped depressions 102 are provided for each battery, and define a stiffening leg between the two depressions. Each bottom depression 102 has an inwardly inclined wedge surface 104 which extends rearwardly from the front 72 and adjoins a bottom depression floor 105 a front dimple 106 extends inwardly from the wedge surface 104 and a rear dimple 108 extends inwardly from the depression floor 105. The dimples 104, 108 are supported resiliently against the battery 68 negative terminal end 110. The conical surface 112 which extends between the depression floor and the bottom 66 of the blister assists in biasing the dimples 106, 108 against the negative terminal end 110 of the battery 68. The wedge surface 104, together with the front 106 and rear 108 dimples, creates a progressive biasing feature which accommodates batteries of varying radial and lengthwise dimensions. The front dimple 106 will engage with the outer lip 111 of a battery negative terminal end, if one is present, and the rear dimple 108 will engage with the inner lip 113 of a battery negative terminal.

The blister 54 incorporates denesting features 114 best shown in FIG. 6. The denesting features 114 are outwardly protruding steps which extend above the level of the card 62 and prevent the blisters 54 from nesting too closely when they are stacked together for transportation and inventory by the blister manufacturer. Too close nesting is undesirable as it can increase the force needed to separate one blister from another. It also complicates the design of machinery to mechanically successively denest the blisters so that automated machinery may be used in the battery packaging lines.

The stiffening structure of the blister 54 produces a gripping structural element in the form of the nubbin caps 76 which have greater biasing potential than conventional battery blister packs 22, 24, 26. The greater structural stiffness of the top combined with the progressive nature of the retentive features such as the nubbin caps 76 and the bottom depressions 102 allow the blister 54 to accommodate batteries of the "D" size with a range of dimensions such that two or more types of "D" cells may be packaged with a single blister 54. The blister 54 will be combined with a number of different blister cards 62 on which printed indicia appears which advise the consumer of the particular characteristics and advantages of a particular type of battery.

The ability of the blister 54 to accommodate various "D" cells affords two important advantages. The first is a reduction in blister inventory. This in turn facilitates the goals of implementing modern production methods to improve quality while also lowering costs. By eliminating inventory, the costs associated with financing and storing inventory are eliminated. With the Just-In-Time Inventory concept, problems in quality control are recognized in the final product by direct feedback to the manufacturer of the blister 54. The Just-In-Time inventory method avoids the cost of a large inventory of possibly defective product which is inherent in older methods of production. The blister 54 facilitates the modern method of quality control wherein quality is not achieved by multiple expensive inspections along the chain of manufacturing steps. Rather, the quality of the product is assessed in the final steps of production by the personnel actually involved in the manufacturing process. Upon detection of a problem with quality control, the entire production process is stopped. The problem is fixed. Then production is begun again. This system prevents the production of large quantities of defective goods and disciplines the entire manufacturing chain. However, this process can only be used where inventory and delivery schedules are short, a process facilitated by the blister 54.

The second advantage produced by the blister 54 is its ability to facilitate the second important feature of the modern manufacturing revolution which is the rapid change-over from the production of one product to another on the same assembly line. This ability to rapidly change from one product to another in turn produces three advantages: reduced inventories of the final product; rapid response to changes in consumer demand; and the ability to cost-effectively provide a wider range of products. The importance of the last point is seen when it is realized that thirty years ago there was only a single type of "D" cell, whereas today competitive forces require at least three or four, and the future undoubtedly will bring yet more choices to the consumer. Thus, the features incorporated in the blister 54 are fundamental to implementing modern manufacturing and production techniques on the battery packaging line.

Figure 12:
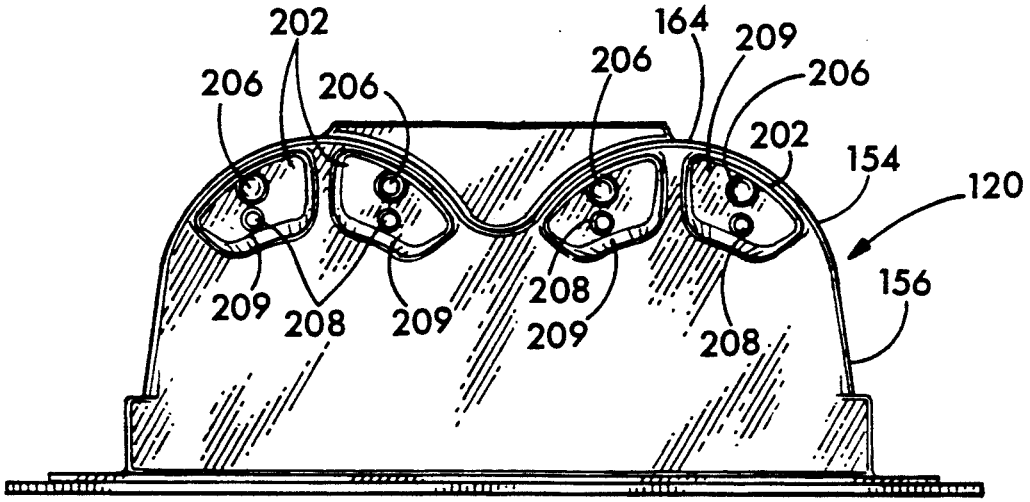
FIG. 12 is a bottom plan view of an alternate embodiment of a battery blister package of the present invention.
Figure 13:
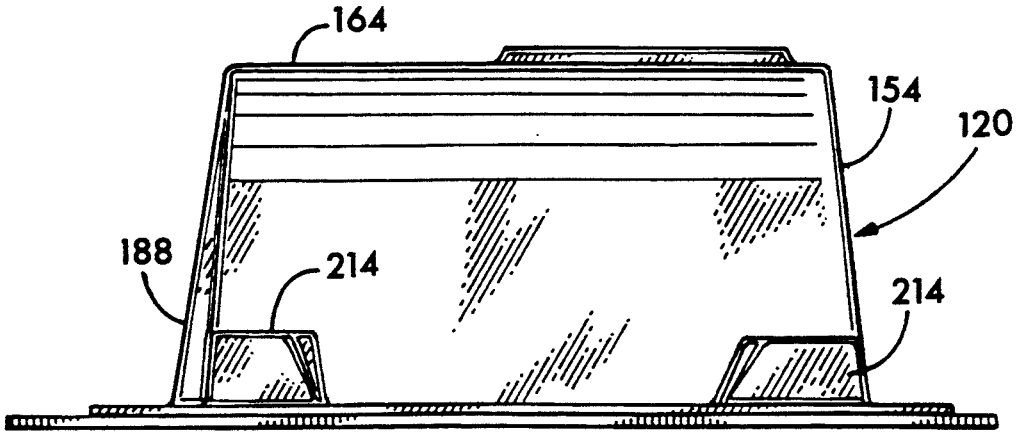
FIG. 13 is a side elevational view of the battery blister package of FIG. 12 showing denesting features.

An alternative blister pack 120 is shown in FIGS. 12 and 13. The blister 154 of the blister package 120 combines a bottom depression 202 which extends slightly further into the blister pocket 156 with front dimples 206 and rear dimples 208 which are wholly contained on the surface 209 of the bottom depressions 202. Further, as shown in FIG. 13, the stiffness of the top 164 is somewhat reduced by the lack of the J-shaped lower top segment structures and the central U structures of the package 20. In this embodiment the stiffening legs 188 perform the function of rigidifying the top 164. Denesting protrusions 214 serve a function similar to the denesting features 114 shown in FIGS. 6 and 11.

Figure 14:
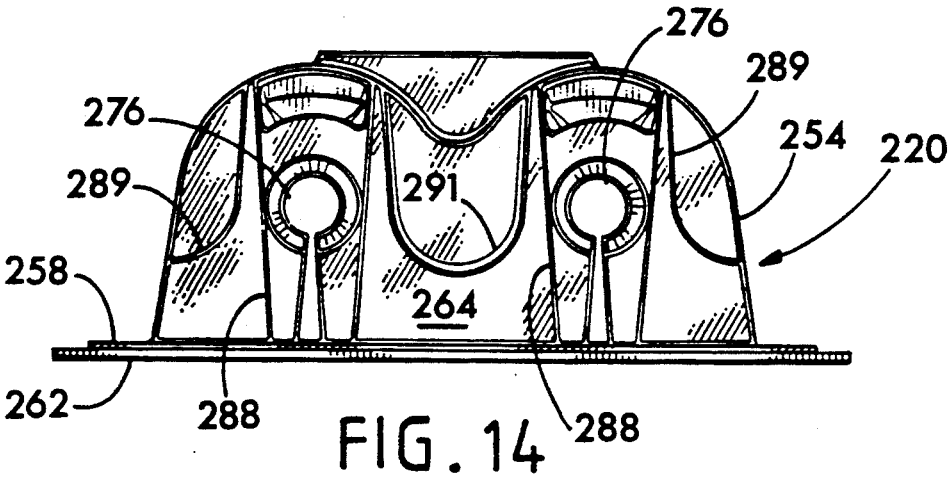
FIG. 14 is a top plan view of another alternative embodiment of the battery blister package of this invention.

Another alternative blister card package 220, shown in FIGS. 14 and 15, is preferably suited to accommodate "C" size cells of varying dimensions. The blister 254 is affixed to a blister card 262 and incorporates the reinforcing structures in the top 264 of the blister 254 including the stiffening arms 288 which reinforce the nubbin caps 276. The outer J-shaped depression structures 289 on either side of the arms 288 on the top face 264 of the blister 254 do not extend as far towards the peripheral lip 258 as do the top segments 89 on the blister 54 shown in FIG. 7. Similarly, the central U structure 291 is not proportionately as large as the central U structure 91 shown in FIG. 7.

The precise shape of the structures on the top face 264 of the blister 254 are designed consistent with the overall dimensions and the amount of resiliency required in a blister 254 for the packaging of standard "C" size cells. The bottom depressions 302 are narrower than the bottom depressions 102, 202 of the blisters 54, 154. Further, the bottom depressions employ a single dimple 306. However, the bottom depression 302 employ inwardly extending wedge surfaces 304 which are reinforced by surfaces 309 to form resilient progressive retention features or wedges on the bottom surface 266. These features operate with nubbin caps 276 and the top face 264 rigidifying structure to form a blister 254 which will resiliently retain and prevent the rotation of "C" cells of varying dimensions with the standard size associated with the designation.

It should be noted that blisters containing one, two, three or more batteries may be constructed according to this invention. Furthermore, the blisters may be attached to the backing card by means of heat activated adhesive, mechanical fasteners, ultrasonic welding and the like. Utilizing the principle of progressive engagement, additional retentive features may be incorporated into the blister structure to accommodate as wide a range of battery geometries as may be required.

It is understood that the invention is not confined to the particular construction and arrangement of parts herein illustrated and described, but embraces such modified forms thereof as come within the scope of the following claims.

We claim:

1. A package for batteries comprising:

(a) a backing member;

(b) a plastic blister having a peripheral lip attached to the backing member, the blister and the backing member defining a space for retaining at least one battery therein, wherein the blister has a bottom which underlies a battery negative terminal, the bottom having portions for resiliently engaging the negative terminal, and wherein the blister has a top which overlies a battery positive terminal; and (c) portions of the blister top which define a generally circular outwardly protruding cap which engages a protruding nubbin of a battery and an outwardly protruding stiffening arm extends between the cap and the blister peripheral lip to bias the cap against a battery nubbin, wherein the engaged battery is held by the package to resist rotation of batteries of varying dimensions within a standard size.

2. The battery package of claim 1 further comprising portions of the blister top which define an inwardly extending wedge located frontwardly of the nubbin cap, the wedge having surfaces which engage with protruding structure of a battery positive contact end.

3. The battery package of claim 1 further comprising reinforcing structure formed in the blister top comprising at least two outwardly protruding legs which extend from the peripheral lip to a position frontward of the nubbin cap.

4. The battery package of claim 1 wherein the portions of the blister bottom which engage the negative terminal comprise an inwardly protruding depression having a first inwardly extending dimple which is located proximate a blister front, and a second inwardly extending dimple located rearwardly of the first dimple.

5. A package for batteries comprising:

(a) a backing member;

(b) a plastic blister having a peripheral lip attached to the backing member, the blister and the backing member defining a space for retaining at least one battery therein, wherein the blister has a bottom which underlies a battery negative terminal, and wherein the blister has a top which overlies a battery positive terminal;

(c) means for resiliently engaging the negative terminal end of a battery formed on the blister bottom;

(d) means for resiliently engaging the nubbin of a battery positive terminal end formed on the blister top; and (e) means for resiliently engaging an annular depression in a battery positive terminal end formed on the blister top, wherein the engaged battery is held by the package to resist rotation of batteries of varying dimensions within a standard size.

6. The battery package of claim 5 further comprising reinforcing structure formed in the blister top comprising at least two outwardly protruding legs which extend from the peripheral lip to a position frontward of the nubbin cap.

7. A thermoformed plastic blister adapted for packaging at least one battery, the blister comprising:

(a) a peripheral flange which is adapted for mounting to a backing card;

(b) a pocket extending frontwardly from the flange, the pocket being defined by a blister top, a blister bottom, and two blister sides which extend frontwardly from the flange and which are all joined by a blister front;

(c) portions of the blister top which are adapted to engage a protruding battery positive terminal nubbin;

(d) at least two inwardly extending depressions located on the blister bottom adapted to be adjacent to each packaged battery;

(e) a first dimple extending inward from each bottom depression and located adjacent the blister front; and (f) a second inwardly extending dimple located rearwardly of the first dimple within each bottom depression, wherein the first or the second or both dimples may engage with features of the negative contact end of a packaged battery, depending on the geometry of a particular battery, wherein the dimples restrict front-to-back displacement of a packaged battery.

8. The battery package blister of claim 7 further comprising portions of the blister top which define an inwardly extending wedge having surfaces which engage with protruding structure of a battery positive contact end.

9. The battery package of claim 7 further comprising reinforcing structure formed in the blister top comprising at least two outwardly protruding legs which extend from the peripheral lip to the blister front.

10. The blister of claim 7 wherein the positive terminal nubbin engaging portions of the blister top comprise a generally circular cap which is positioned to overlie a nubbin, the cap having a generally frustoconical sidewall to engage against nubbins over a range of diameters.

* * * * *